US007121484B2

(12) United States Patent
Daley

(10) Patent No.: US 7,121,484 B2
(45) Date of Patent: Oct. 17, 2006

(54) CARRIAGE FOR A POWER WASHER WAND

(76) Inventor: Howard Daley, 913 Mid Bluff Dr., Zeeland, MI (US) 49464

( * ) Notice: Subject to any disclaimer, the term of this patent is extended or adjusted under 35 U.S.C. 154(b) by 231 days.

(21) Appl. No.: 10/919,378

(22) Filed: Aug. 17, 2004

(65) Prior Publication Data

US 2006/0038033 A1 Feb. 23, 2006

(51) Int. Cl.

| | |
|---|---|
| ***B05B 3/00*** | (2006.01) |
| ***B05B 3/18*** | (2006.01) |
| ***B08B 3/00*** | (2006.01) |
| *A62C 31/24* | (2006.01) |
| *B05B 15/06* | (2006.01) |

(52) U.S. Cl. ..... 239/754; 239/280; 239/280.5; 239/281; 239/289; 239/532; 239/530; 239/150; 239/159; 239/722; 239/526; 239/164; 401/48; 401/193; 134/198

(58) Field of Classification Search ..... 239/754, 239/722, 280, 281, 280.5, 289, 532, 530, 239/150, 159, 164, 165, 176, 288, 526; 401/48, 401/193; 15/230.11; 403/362, 396; 134/198, 134/115 R, 172

See application file for complete search history.

(56) References Cited

U.S. PATENT DOCUMENTS

| | | | | |
|---|---|---|---|---|
| 1,570,787 | A * | 1/1926 | Schroeder | 280/62 |
| 3,540,632 | A * | 11/1970 | Clingan | 222/626 |
| 3,857,515 | A * | 12/1974 | Zennie | 239/169 |
| 4,083,495 | A * | 4/1978 | Sharp | 239/754 |
| 4,191,590 | A | 3/1980 | Sundheim | |
| 4,262,821 | A * | 4/1981 | Smrt | 222/162 |
| 4,462,328 | A | 7/1984 | Oram | |
| 4,892,251 | A * | 1/1990 | Bresnen | 239/150 |
| 4,984,746 | A * | 1/1991 | Joyal | 239/722 |
| 5,263,789 | A * | 11/1993 | Torntore et al. | 404/93 |
| 5,265,805 | A | 11/1993 | Artenian | |
| 5,293,887 | A * | 3/1994 | Thibodeaux | 134/24 |
| 5,718,534 | A * | 2/1998 | Neuling | 404/94 |
| 5,898,970 | A | 5/1999 | Straiton | |
| 6,105,204 | A | 8/2000 | Scharwat | |
| 6,267,308 | B1 * | 7/2001 | Hall | 239/754 |
| 6,409,191 | B1 * | 6/2002 | Wang et al. | 280/87.041 |
| 6,478,507 | B1 * | 11/2002 | Schroeder et al. | 404/94 |
| 2002/0184729 | A1 | 12/2002 | Farina | |
| 2002/0190145 | A1 | 12/2002 | Sheppard, Jr. | |
| 2003/0010852 | A1 | 1/2003 | Schommer | |
| 2005/0217708 | A1 * | 10/2005 | Otterson. | 134/34 |

* cited by examiner

*Primary Examiner*—David A. Scherbel
*Assistant Examiner*—James S. Hogan
(74) *Attorney, Agent, or Firm*—Diller, Ramik & Wight

(57) ABSTRACT

A carriage designed for supporting a power washer wand and its nozzle a predetermined, though adjustable, distance from a surface which is to be cleaned by high velocity water exiting a discharge orifice of the nozzle. The carriage is defined by a one-piece body molded from substantially high strength synthetic polymeric/copolymeric plastic material. The carriage body includes a platform having a converging front end nose upwardly from which projects a wand support having a channel in which a power washer wand is located and adjustably clamped. The platform includes two wheels at a rear end thereof and a single wheel beneath the front end nose.

9 Claims, 2 Drawing Sheets

FIG.1
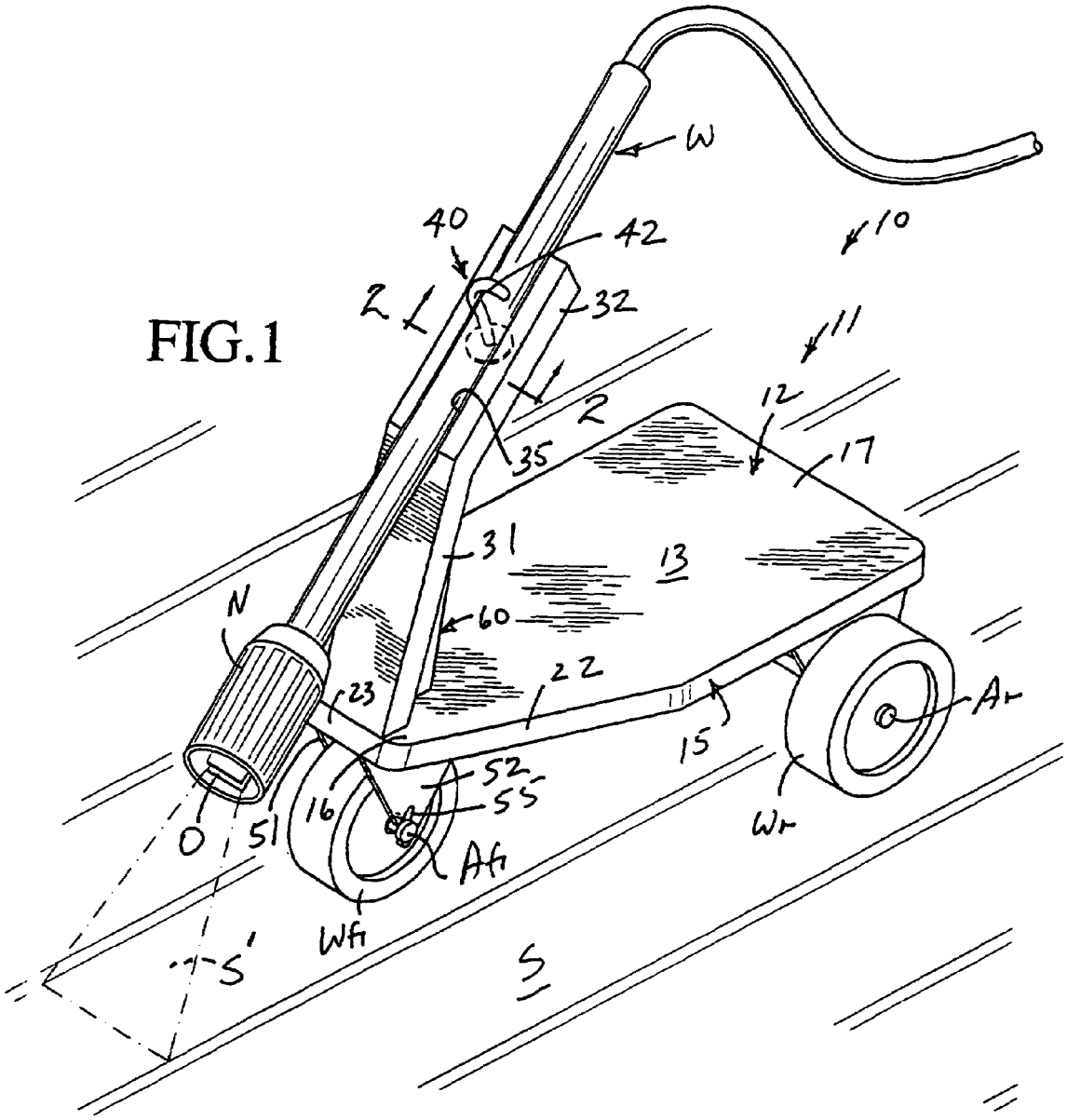
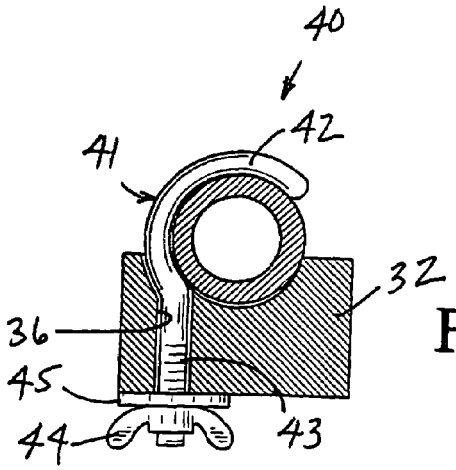
FIG.2

CARRIAGE FOR A POWER WASHER WAND

BACKGROUND OF THE INVENTION

Heretofore a variety of different wheeled carriages or platforms have been provided for movably and/or adjustably supporting devices which perform disparate functions.

One such device is the line marking device of U.S. Pat. No. 4,892,251 granted on Jan. 9, 1990 to Harrison Bresnen. An airless paint spray mechanism is adjustably attached to a four-wheeled carrier to deliver a trapezoidal paint spray to the surface of a road or pavement to mark stripes of varying widths.

U.S. Pat. No. 5,265,805 granted on Nov. 30, 1993 to Steven M. Artenian discloses an apparatus for cleaning parking lots, sidewalks and the like utilizing hot pressurized water which sprays downwardly within a manifold similar to a lawnmower chassis. A group of spray nozzles rotate in a plane parallel to the surface which is to be cleaned, and the chassis includes two rear wheels and a single forward wheel for easing movement during cleaning.

U.S. Pat. No. 5,898,970 granted on May 4, 1999 to John H. Straiton discloses another ground surface cleaner, and though the cleaning nozzle associated therewith is not mounted on a platform, ancillary mechanisms are so mounted and the platform includes rollers or wheels.

U.S. Pat. No. 4,191,590 granted on Mar. 4, 1980 to John J. Sundheim is another example of an apparatus for cleaning ground surfaces by utilizing a mechanism similar to a lawnmower except the mechanism utilizes rotating nozzles to create high pressure/velocity sprays directed at the surface to be cleaned.

U.S. Pat. No. 4,462,328 granted on Jul. 31, 1984 to Steven W. Oram discloses a cleaning device for removing foulant from the hull of seagoing vessels which includes a carriage of a generally triangular configuration having three wheels associated therewith.

U.S. Pat. No. 6,267,301 B1 granted on Jul. 31, 2001 to Tommy Hall is another example of a pressure washer assembly which includes a polygonal base, two rear wheels and a single front guide wheel. A pair of sidewise directed nozzles are carried by the assembly to facilitate the power washing/cleaning of curbs.

Other typical prior art selected during a search of the present invention is found in the below listed patent and patent application publications:

| | | |
|---|---|---|
| U.S. Pat. No. 6,105,204 | Aug. 24, 2000 | Schwarat |
| Pub. No.: US 2002/0184729 A1 | Dec. 12, 2002 | Farina |
| Pub. No.: US 2002/0190145 A1 | Dec. 19, 2002 | Sheppard, Jr. |
| Pub. No.: US 2003/0010852 A1 | Jan. 16, 2003 | Schommer |

The devices of the latter patent and patent application publication singularly and collectively achieve specific intended purposes, but all are characterized by one or more structural, functional or manufacturing disadvantages. For example, most of the devices are very large, cumbersome, constructed from a multiplicity of parts, are very expensive to manufacture, assembly thereof is obviously time-consuming and costly, and from a functional standpoint, the devices cannot be readily, reliably and easily manually manipulated to direct high velocity spray to precise and difficult-to-access areas.

SUMMARY OF THE INVENTION

With the foregoing in mind, the present invention provides a carriage for supporting a power washer wand which eliminates the disadvantages of the devices exemplified by the prior art described earlier and listed herein through the construction of a polymeric/copolymeric molded one-piece homogeneous carriage which is defined by a platform, wheel axle supports on an underside of the platform and a wand support projecting upwardly from a forwardly converging nose of the platform. The converging and narrow nature of the nose facilitates accessability of the carriage and the associated high velocity water spray to difficult-to-access areas which are to be cleaned. Additionally, the power washer wand is adjustably supported by the wand support but, more importantly, the wand support is inclined rearwardly at two angles, one between a lower wand support portion of the platform and the other between the lower wand support portion and an upward wand portion to achieve the most efficient spray angle relative to the surface which is to be cleaned to achieve maximum cleaning in the shortest amount of time without damage (gouging wood of decks, for example). A single wheel is also provided immediately beneath the nose of the platform which further augments the ease of positioning the nozzle with respect to hard-to-access areas (corners, etc.).

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 1 is a perspective view of a novel carriage for a power washer wand constructed in accordance with this invention, and illustrates a wheeled platform having a forwardly converging nose upwardly from which rises a wand support and upon which is adjustably secured and supported a power washer wand having a nozzle from which is emitted a high velocity water spray.

FIG. 2 is a cross-sectional view taken generally along line 2—2 of FIG. 1, and illustrates a J-shaped clamp secured to the upper wand support section for securing the power washer wand thereto.

DESCRIPTION OF THE PREFERRED EMBODIMENTS

Figure 4:
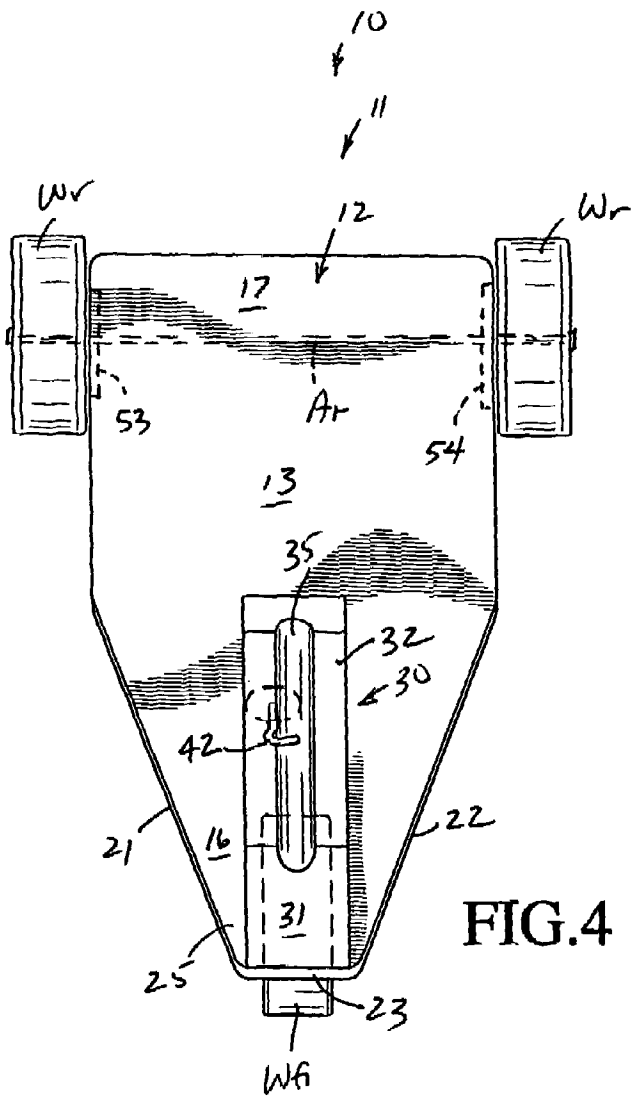
FIG. 4 is a top plan view, and illustrates the triangular orientation of the two rear wheels and a front wheel beneath a narrow fowardly converging nose of the carriage platform.
Figure 3:
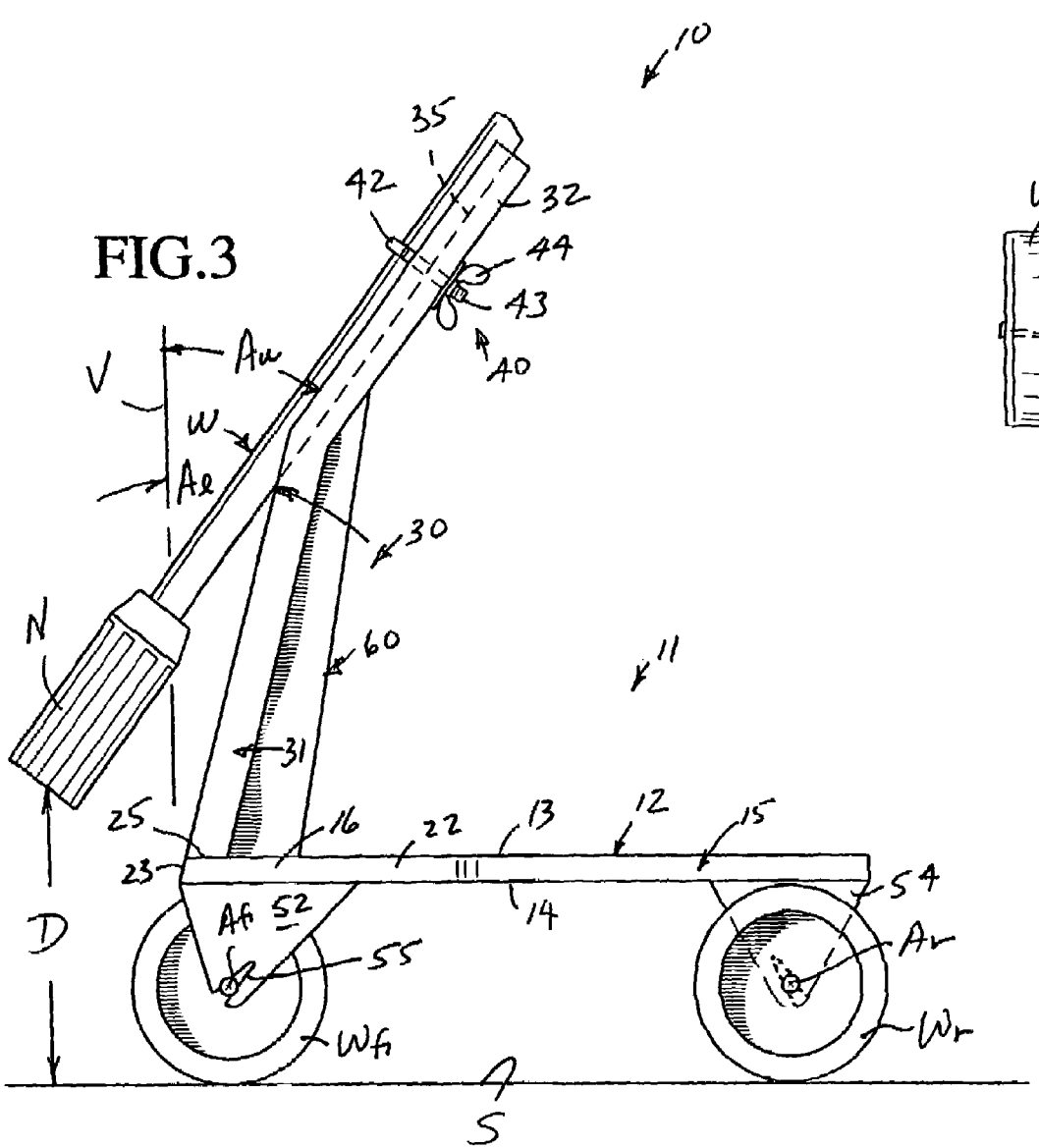
FIG. 3 is a side elevational view, and illustrates with more particularity the angle defined by a longitudinal axis of the power washer wand and a horizontal plane taken through the platform of the carriage.

A carriage 10 particularly adapted for supporting a power washer wand W and an associated high pressure nozzle N thereof a predetermined, though adjustable, distance from a surface S which is to be cleaned by a high velocity water spray S' exiting a discharge orifice O of the nozzle N is fully illustrated in FIGS. 1, 3 and 4 of the drawings.

The carriage 10 includes a one-piece carriage body 11 molded from substantially homogeneous, high strength, synthetic polymeric/copolymeric plastic material, such as structural foam polypropylene injection molded in a die draw aluminum mold.

The carriage body 11 includes a platform 12 defined by an upper surface 13, a lower surface 14 and a peripheral surface or peripheral edge 15 between the upper and lower surfaces 13, 14, respectively. The platform 12 further includes a front platform end portion 16 and a rear platform portion 17 with the front platform portion 16 being defined between opposite front side edge portions 21, 22 and a front edge portion 23 therebetween with the latter edge portions in part defining the peripheral edge 15. The opposite front side edge portions 21, 22 of the peripheral edge 15 converge toward each other in a direction away from the platform rear end portion 17, as is best illustrated in FIG. 4, to define a substantially narrow platform front nose 25. Because of the relatively narrow and converging nature of the platform front nose 15, the spray S' can be directed into relatively inaccessible hard-to-access areas which are not otherwise readily accessed, such as corners of decks which are being power washed.

The platform 12 further includes a wand support 30 defined by a lower wand support portion 31 and an upper wand support portion 32. The lower wand support portion 31 projects upwardly from the platform nose 25 and define an acute angle $A_l$ with a vertical plane V which ranges between 5 degrees to 14 degrees and is preferably 7 degrees. The upper wand support portion 31 defines an acute angle $A_u$ . with the vertical plane V which ranges between 10 degrees to 28 degrees and is preferably 14 degrees. The preferred 14 degree angle $A_u$ effectively causes the spray S' to be directed against the surface S at an angle of approximately 76 degrees which effects maximum efficient cleaning absent surface damage (gouging, etc.).

The upper wand support portion 32 has an upper surface defining an elongated upwardly opening channel 35 (FIGS. 2 and 4) which supportingly receives therein the power wash wand W. The channel 35 is substantially semi-circular in cross-section (FIGS. 2 and 4) and snugly embraces thereby an exterior surface (unnumbered) of the wand W along the entire length of the channel 35 which corresponds substantially to the length of the upper wand support portion 32 (FIG. 3).

Means 40 (FIG. 2) is provided for selectively adjustably clamping the power washer wand W in the channel 35. The clamping means 40 includes a J-bolt 41 having a curved washer wand embracing end 42 and a threaded end portion 43 passing through an opening 36 of the upper wand support portion 32 and a wingnut 44 threaded thereupon in conjunction with an associated conventional washer 45. An axis (unnumbered) of the threaded portion 43 is offset from a plane through the center of the channel 35, as is best envisioned in FIGS. 2 and 4 of the drawings. By loosening the wingnut 44, the wand W can be appropriately slid within the channel 35 to selectively adjust the distance D between the nozzle orifice O and the surface S (FIG. 3) after which the wingnut 44 is hand-tightened.

The carriage 11 further includes a pair of downwardly projecting, relatively spaced, substantially triangular front axle retaining brackets 51, 52 and a similar pair of rear axle retaining brackets 53, 54 located respectively adjacent side edge portions (unnumbered) of the peripheral edge 15. A front axle $A_f$ is snap-secured in and retained by downwardly opening slots 55 in each of the brackets 51, 52. Like slots 56 are utilized with the brackets 53, 54 (FIG. 4) for retaining a rear axle $A_r$ and the rear wheels $W_r$ associated therewith.

Due to the one-piece molded construction of the carriage body 11 thus far described, the carriage 10 is suited for its intended purpose of quickly and efficiently power washing surfaces absent further refinement. However, to assure the integrity of the carriage 10 against excessive abuse, as is not uncommon, means 60 in the form of a reinforcing rib extending between the platform 12 and the junction between the lower wand support portion 31 and the upper wand support portion 32 is provided to rigidify the wand support 30 and the juncture thereof with the platform 12. The reinforcing rib 60 is, of course, formed during the one-piece molding of the overall platform body 11 and is preferably positioned at a rearward side of the lower wand support 31 to preclude interference with the adjustment of the wand W and the specific location of the nozzle N thereof. The reinforcing rib 60 is also preferably located along a centerline of the wand support 30, as is best visualized in FIG. 4 of the drawings.

Although a preferred embodiment of the invention has been specifically illustrated and described herein, it is to be understood that minor variations may be made in the apparatus without departing from the spirit and scope of the invention, as defined by the appended claims.

What is claimed is:

1. A carriage particularly adapted for supporting a power washer wand and an associated high pressure nozzle thereof a predetermined, though adjustable, distance from a surface which is to be cleaned by a high velocity water spray exiting a discharge orifice of the nozzle comprising a one-piece carriage body molded from substantially high strength synthetic polymeric/copolymeric plastic material, said carriage body including a platform defined by upper and lower surfaces, a peripheral edge between said upper and lower surfaces and front and rear platform end portions; said platform front end portion being defined by opposite front side edge portions of said peripheral edge converging in a direction away from said platform rear end portion to define a substantially narrow platform front nose whereby relatively inaccessible surfaces are substantially readily accessed and power washed, a wand support, said wand support including lower and upper wand support portions, said lower wand support portion projects upwardly from said platform front end portion and defines an obtuse angle with said upper wand support portion, said upper wand support portion having an upper surface defining an elongated upwardly opening channel adapted to supportingly receive therein a power washer wand with its associated nozzle discharge orifice disposed forward of said platform front nose, means for selectively adjustably clamping a power washer wand in said channel, a pair of wheels beneath said platform rear end portion, and a single wheel beneath said platform front end portion contiguous said platform front nose.

2. The carriage as defined in claim 1 wherein said lower wand support and platform lie in planes which define an acute angle therebetween, and said lower wand support portion plane is inclined toward said platform rear end portion.

3. The carriage as defined in claim 1 including means for reinforcing said lower wand support portion substantially between said upper wand support portion and said platform front nose.

4. The carriage as defined in claim 1 including means for reinforcing said lower wand support portion substantially between said upper wand support portion and said platform front nose, and said reinforcing means is a reinforcing rib.

5. The carriage as defined in claim 1 including means for reinforcing said lower wand support portion substantially between said upper wand support portion and said platform front nose, and said reinforcing means is a reinforcing rib along a rearward facing side of said lower wand support portion.

6. The carriage as defined in claim 1 wherein said clamping means includes a J-bolt having a curved washer wand embracing end and a threaded end portion passing through an opening in said upper wand support portion, and a wingnut threaded upon said J-bolt threaded end portion at a side of said upper wand support portion opposite said channel.

7. The carriage as defined in claim 2 including means for reinforcing said lower wand support portion substantially between said upper wand support portion and said platform front nose.

8. The carriage as defined in claim 2 including means for reinforcing said lower wand support portion substantially between said upper wand support portion and said platform front nose, and said reinforcing means is a reinforcing rib.

9. The carriage as defined in claim 2 including means for reinforcing said lower wand support portion substantially between said upper wand support portion and said platform front nose, and said reinforcing means is a reinforcing rib along a rearward facing side of said lower wand support portion.

* * * * *